US008806757B2

(12) United States Patent
Moseman

(10) Patent No.: US 8,806,757 B2
(45) Date of Patent: Aug. 19, 2014

(54) ARCHED HAIR CLIPPER BLADE GUIDE

(75) Inventor: Russell L. Moseman, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 333 days.

(21) Appl. No.: 12/771,039

(22) Filed: Apr. 30, 2010

(65) Prior Publication Data

US 2011/0265331 A1 Nov. 3, 2011

(51) Int. Cl.
*B26B 19/06* (2006.01)

(52) U.S. Cl.
USPC ..... 30/43.92; 30/43.8; 30/43.9; 30/208

(58) Field of Classification Search
USPC ..... 30/43.7–44, 194, 195, 199, 208–210, 30/223, 224, 233, 227, 241, 286, 289, 342, 30/373, 392–394
See application file for complete search history.

(56) References Cited

U.S. PATENT DOCUMENTS

| | | | | | |
|---|---|---|---|---|---|
| 1,729,332 | A | | 9/1929 | Dremel | |
| 1,939,253 | A | * | 12/1933 | Dremel | 30/195 |
| 2,704,887 | A | | 3/1955 | Andis | |
| 2,726,447 | A | | 12/1955 | Maloy | |
| 3,101,535 | A | * | 8/1963 | Andis | 30/29.5 |
| 3,279,062 | A | * | 10/1966 | Andis | 30/210 |
| 3,399,454 | A | * | 9/1968 | Liska | 30/43.92 |
| 3,589,007 | A | | 6/1971 | Walton | |
| 4,249,307 | A | | 2/1981 | Andis | |
| 4,328,616 | A | | 5/1982 | Andis | |
| 4,383,366 | A | | 5/1983 | Andis | |
| 4,458,417 | A | | 7/1984 | Andis | |
| 4,813,133 | A | * | 3/1989 | Locke et al. | 30/215 |
| 4,989,324 | A | | 2/1991 | Andis | |
| 5,092,048 | A | | 3/1992 | Sukow et al. | |
| 5,185,931 | A | | 2/1993 | Fujikawa et al. | |
| 5,579,581 | A | | 12/1996 | Melton | |
| 5,606,799 | A | | 3/1997 | Melton | |
| 5,819,415 | A | | 10/1998 | Bruggers et al. | |
| 6,308,415 | B1 | * | 10/2001 | Sablatschan et al. | 30/43.92 |
| 6,421,922 | B2 | | 7/2002 | Beutel et al. | |
| 6,502,312 | B2 | | 1/2003 | Beutel et al. | |
| 6,742,262 | B2 | * | 6/2004 | Rizzuto, Jr. et al. | 30/201 |
| 6,886,255 | B2 | | 5/2005 | Freas et al. | |
| 6,968,623 | B2 | | 11/2005 | Braun et al. | |
| 7,010,859 | B2 | | 3/2006 | Laube | |

(Continued)

FOREIGN PATENT DOCUMENTS

| | | |
|---|---|---|
| CN | 2497946 | 7/2002 |

OTHER PUBLICATIONS

Office action issued in corresponding CN Application No. 201110114968.3, with translation.

*Primary Examiner* — Andrea Wellington
*Assistant Examiner* — Brendan Ayer
(74) *Attorney, Agent, or Firm* — Greer, Burns & Crain, Ltd.

(57) ABSTRACT

A blade guide for a hair clipper bladeset, the guide configured for slidable engagement in a transverse track of a stationary blade, and including a blade guide body having a first edge and a second edge being generally parallel to and spaced from the first edge, each of the edges having a pair of opposed free ends. At least one arched load beam connects a corresponding opposed pair of the free ends of the first and second edges for exerting a torsion-resisting biasing force between the edges.

18 Claims, 6 Drawing Sheets

(56) References Cited

U.S. PATENT DOCUMENTS

| | | | | |
|---|---|---|---|---|
| 7,350,314 | B2 | 4/2008 | McCambridge et al. | |
| 7,353,762 | B2 | 4/2008 | Mathis | |
| 8,132,332 | B2 * | 3/2012 | Tautscher et al. | 30/43.92 |
| 2005/0011076 | A1 * | 1/2005 | Andis | 30/223 |
| 2006/0042096 | A1 * | 3/2006 | Liao | 30/223 |
| 2009/0056143 | A1 * | 3/2009 | Fukutani et al. | 30/43.92 |

* cited by examiner

ARCHED HAIR CLIPPER BLADE GUIDE

BACKGROUND

The present invention relates to hair clipper bladesets, and more specifically to blade guides used for maintaining alignment between a moving blade and a stationary blade of a clipper bladeset.

In conventional bladesets used in electric hair clipping devices such as hair clippers, trimmers and the like, referred to generally and collectively here as hair clippers, a moving blade is caused to laterally reciprocate relative to a stationary blade to provide a scissors-like cutting action between corresponding and opposing rows of teeth on each blade. The moving blade is usually attached to a blade guide for maintaining alignment between blades during operation. In most cases, the blade guide reciprocates in a transverse track in an upper surface of the stationary blade.

To reduce operational noise, blade guides are typically made of plastic. Conventional blade guides are subject to dimensional change due to plastic creep after extended use due to the properties of the plastic used in their fabrication. Also, the configuration of conventional guides does not adequately resist the torque of the moving blade relative to the stationary blade, such that the respective edges of the two blades become misaligned at the extremities of the blade stroke. This misalignment, also referred to as fishtailing of the moving blade, can in some cases result in pinching or pulling of the skin of the person whose hair is being cut.

Another drawback of conventional blade guides is that the plastic does not adjust well to variations in manufacturing tolerances of the stationary blade. Specifically, a transverse groove or track is cut into the stationary blade and forms the location in which the guide reciprocates during normal clipper operation. If the guide is too tight in the track, the clipper speed will be reduced and component wear accelerated. Alternately, if the guide is too loose in the track, fishtailing and other misalignment is increased. Wear of the plastic guide over time, as well as material creep, have also been known to increase the chance of fishtailing.

SUMMARY

The above-listed needs are met or exceeded by the present blade guide, which features the ability to maintain alignment of the moving blade to the stationary blade during the full moving blade stroke length. A pre-loaded configuration enables the present blade guide to react as a solid to the momentary loads experienced during normal clipper operation. Using the present blade guide, the moving blade is virtually free of the customary swaying, fishtailing or torsional misalignment found in conventional bladesets. The result is a more precise linear movement of the moving blade relative to the stationary blade, producing a superior cut to that achieved with conventional bladesets. Further, the material for making the guide is selected to reduce friction and also to more consistently retain its shape over time and accommodate wear. In addition, the pre-loaded configuration of the present guide, in combination with the material used to make it, accommodates manufacturing tolerances better than conventional blade guides while maintaining proper blade alignment.

More specifically, a blade guide is provided for a hair clipper bladeset, the guide configured for slidable engagement in a transverse track of a stationary blade, the guide including a blade guide body having a first edge and a second edge being generally parallel to and spaced from the first edge, each of the edges having a pair of opposed free ends. At least one arched load beam connects an opposed pair of corresponding free ends of the first and second edges for exerting a torsion-resisting biasing force between the edges.

In another embodiment, a blade guide for a hair clipper bladeset is provided, the guide being configured for slidable engagement in a transverse track of a stationary blade. The guide includes a blade guide body having a first edge and a second edge being generally parallel to and spaced from the first edge. An arched load beam connects opposing contact pads of the first and second edges to resist torsional misalignment of a moving blade attached to the body as the body reciprocates relative to the stationary blade.

In yet another embodiment, a hair clipper bladeset is provided, including a stationary blade having a toothed edge and an upper surface defining a recessed transverse track having opposed edges, a moving blade with a toothed edge and an underside defining a guide recess. A blade guide is provided with a blade guide body having a first edge and a second edge being generally parallel to and spaced from the first edge. Each of the edges is configured for slidably engaging the stationary blade recessed track, and each edge has a pair of opposed free ends. At least one arched load beam connects a corresponding opposed pair of the free ends of the first and second edges for exerting a compression-resisting biasing force between the edges.

DETAILED DESCRIPTION

Figure 1:
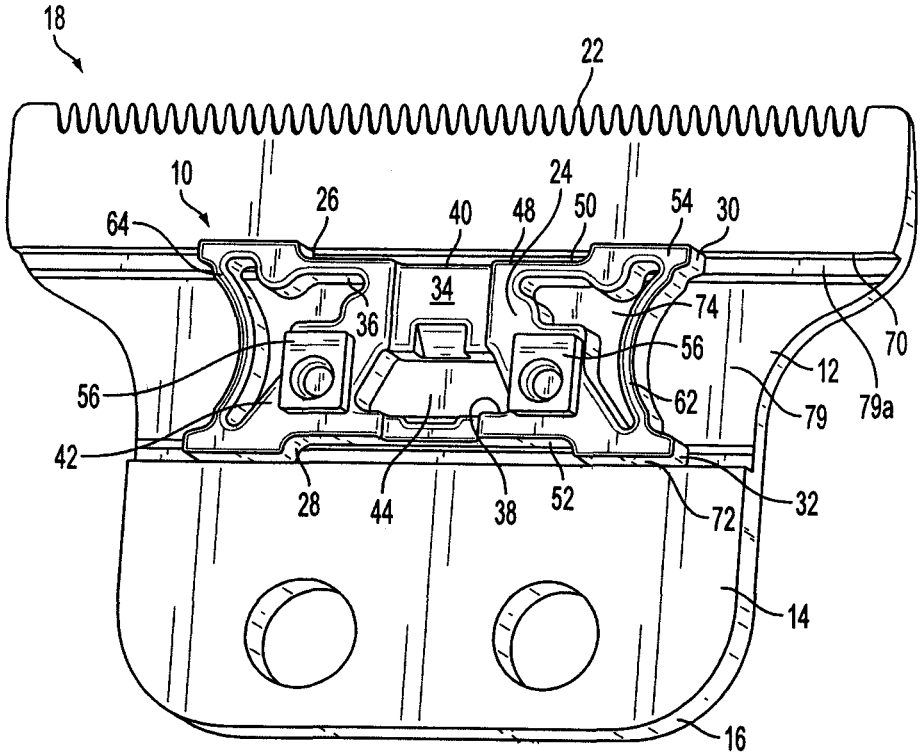
FIG. 1 is a top perspective view of the present blade guide mounted on a stationary blade of a clipper bladeset.

Referring now to FIGS. 1-4, a blade guide incorporating the features of the present invention is generally designated 10 and is shown located in a transverse track 12 of an upper surface 14 of a stationary blade 16 of a hair clipper bladeset 18. The bladeset 18 is completed once a moving blade 20 is secured to the blade guide 10 (FIG. 4) as will be described in further detail below. As is known in the hair clipper art, the function of the blade guide 10 is to maintain alignment of the moving blade 20 as it reciprocates relative to the stationary blade 16 under the power of a hair clipper drive system. General types of suitable clipper drive systems are described in U.S. Pat. Nos. 5,068,966; 5,606,799; 6,739,053 and 7,624,506, all of which are incorporated by reference, as well as other conventional clipper bladeset drive systems.

More specifically, the blade guide 10 slidably engages the transverse track 12 and assures that corresponding rows of teeth 22 on each of the blades 16, 20 are in opposed engagement with each other to effect a scissors-type cutting action as the moving blade 20 reciprocates relative to the stationary blade 16. An important feature of the present blade guide 10 is that it maintains proper alignment of the blades 16, 20 even at ends of the moving blade's linear cutting stroke. In addition, the present blade guide 10 is configured for maintaining such alignment over the working life of the bladeset 18 in a more consistent manner than was available from conventional blade guides.

Included on the blade guide 10 is a blade guide body 24 having a first edge 26 located closer to the teeth 22, and a second edge 28 opposite to the first edge, being generally parallel to and spaced from the first edge. Each of the first and second edges 26, 28 has a pair of opposed free ends correspondingly designated 30 and 32.

A main portion 34 of the blade guide body 24 provides structural support for the edges 26, 28 and in the preferred embodiment defines an angled truss between respective inner surfaces 36, 38 of the first and second edges 26, 28. While other configurations are contemplated, the truss defined by the main portion 34 is generally "V"-shaped, with an apex 40 located adjacent a first edge inner surface 36, and a pair of legs 42 extending from the apex to a second edge inner surface 38.

The main portion 34 defines a cam clearance recess 44 between inner surfaces 46 of the legs 42 of the "V"-shaped truss. This clearance recess 44 is used for accommodating a drive member of the clipper drive system (not shown).

Opposite the recess 44, the body 24 apex 40 forms a solid support portion adjoining a recessed arm 48 in the first edge 26. A similar recessed arm 48 is formed in the second edge 28. Exterior surfaces 50, 52 of the first and second edges each define at least one and preferably a pair of contact pads 54 configured for slidably engaging the transverse track 12. Also included on the main portion 34 is at least one moving blade mounting point 56. Preferably the mounting points 56 are provided in the form of a pair of spaced raised bosses. In the preferred embodiment, the bosses 56 are bored for receiving a threaded fastener 58 (FIG. 4), but are also contemplated as being provided in solid form at 60 (FIG. 7) for serving as locating lugs.

Referring again to FIGS. 1-3, an important feature of the present blade guide 10 is at least one arched load beam 62 connecting a corresponding opposed pair of the free ends 30, 32 of the first and second edges 26, 28. Each arched load beam 62 is provided for exerting a torsion-resisting biasing force between the edges. The arched load beams 62 are preferably preloaded in that they are forced into compression when the guide 10 is placed into operational position in the transverse track 12.

It has been found that compression is the most advantageous stress to induce on the polyoxymethylene or polyacetal material (one popular brand being Delrin® material) preferably used to make the guide 10. This material is preferred because of its property of temporary deformation and creep which recovers its shape upon removal of operational loads. Preferably, the material is Teflon PTFE-filled for lower friction and longer guide life. In the preferred guide 10, the material will typically recover approximately 90% of its unstressed size. Further, the present blade guide 10 equipped with arched load beams 62 constructed of such material or the like acts as a solid piece when exposed to the temporary loads generated during cycling.

Figure 2:
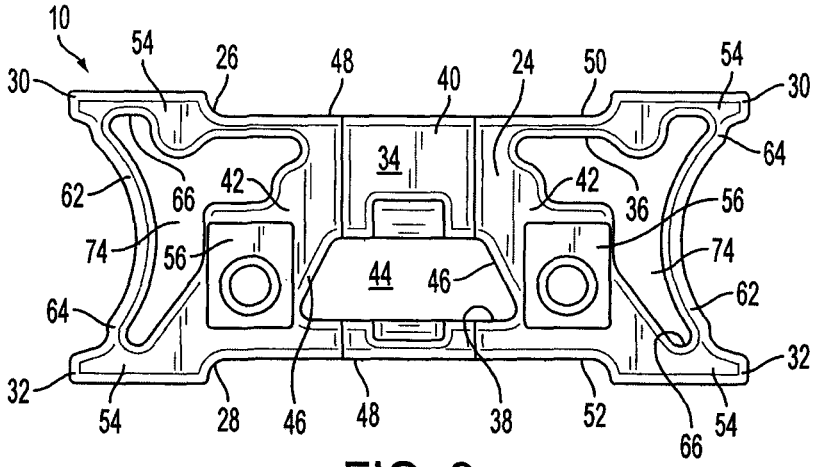
FIG. 2 is a front view of the present blade guide.
Figure 3:
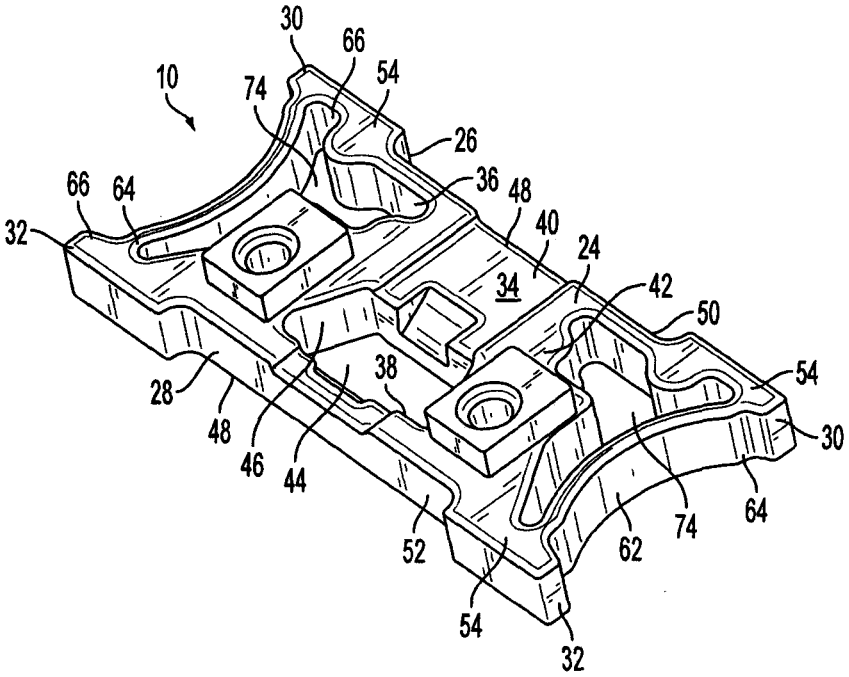
FIG. 3 is a top perspective view of the present blade guide.

Referring to FIGS. 2 and 3, it will be seen that each of the load beams 62 is convex relative to the guide body 24. Further, the beams 62 on opposite ends of the blade guide 10 are complementary in their curvature, in that the arches curve toward each other and toward the main body portion 34. Also, ends 64 of each load beam 62 are attached, preferably by being integrally formed, to inner surfaces 66 of the contact pads 54 at locations spaced inwardly from corresponding free ends 30, 32 of the first and second edges, 26, and 28. Thus, each arched load beam 62 connects free ends 30, 32 at both ends of the guide 10.

Figure 5:
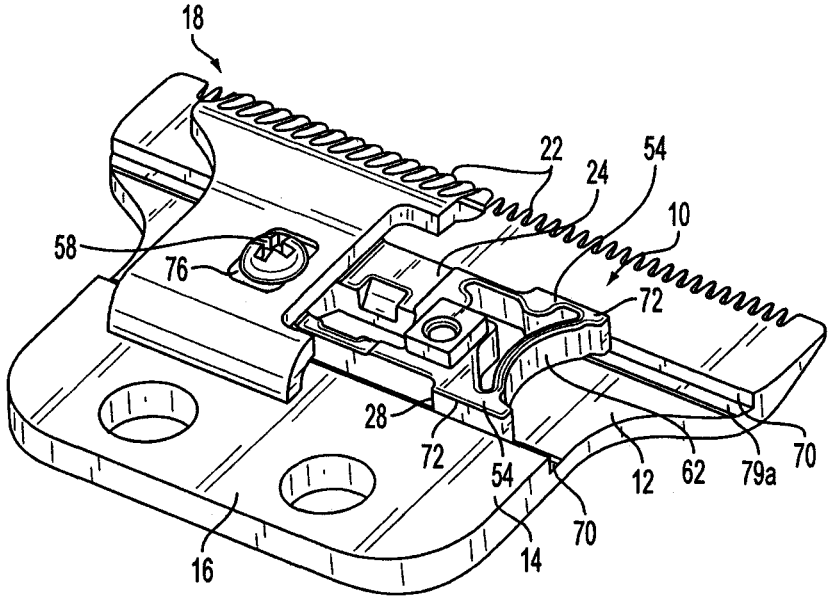
FIG. 5 is a fragmentary perspective view of the bladeset of FIG. 4.
Figure 6:
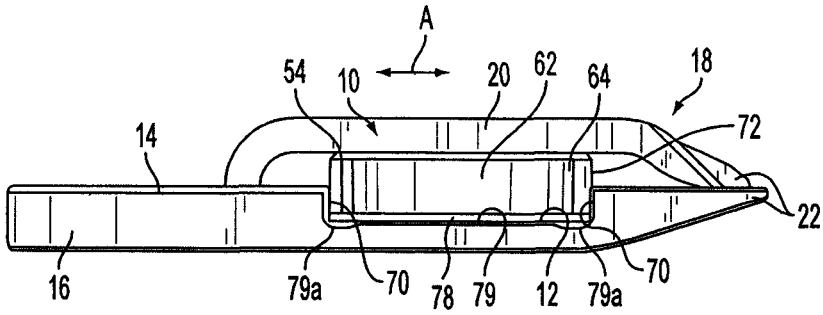
FIG. 6 is a side elevational view of the bladeset of FIG. 4.

Referring now to FIGS. 1, 5 and 6, it will be seen that the transverse track 12 has a pair of spaced, parallel vertical edges 70, and that exterior surfaces 72 of the contact pads 54 slidably engage the edges. The construction of the guide 10 is such that placement in the track 12 so that the contact pads 54 engage the edges 70 as shown places the arched load beams 62 into compression, thus resisting torsional fishtailing forces. Engagement of the contact pads 54 with the edges 70 is enhanced by connecting opposed contact pads on each of the first and second guide edges 26, 28 with the recessed arms 48, thus concentrating the loading force on the edges at the contact pads. An internal space 74 is defined by the arched load beams 62, the leg 42 and the inner surface 36 of the first edge 26.

Figure 4:
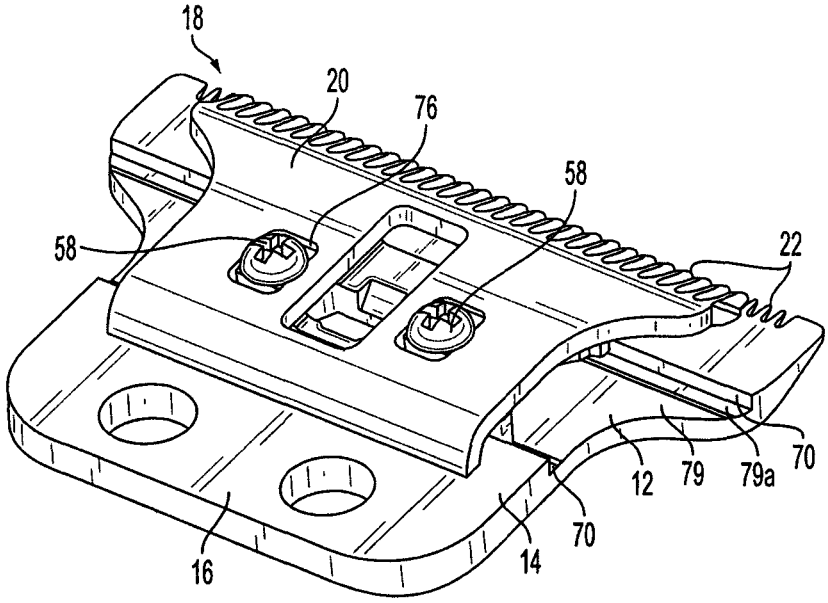
FIG. 4 is a top perspective view of a clipper bladeset equipped with the present blade guide.

Referring now to FIGS. 4 and 5, the guide 10 is considered to be adjustable, in that the fasteners 58 securing the moving blade 20 to the guide may be loosened to allow adjustment of the moving blade 20 relative to the stationary blade 16. Slots 76 in the moving blade 20 permit relative adjustment of the operational position of the moving blade to the stationary blade 16 in the direction of arrows "A" (FIG. 6).

Referring now to FIG. 6, it is preferred that a lower surface 78 of the blade guide 10 is generally planar. Additionally, there should be a space or gap between the lower surface 78 and a corresponding surface 79 of the transverse track 12, having parallel, depressed trough portions 79*a* adjacent the edges 70.

Figure 7:
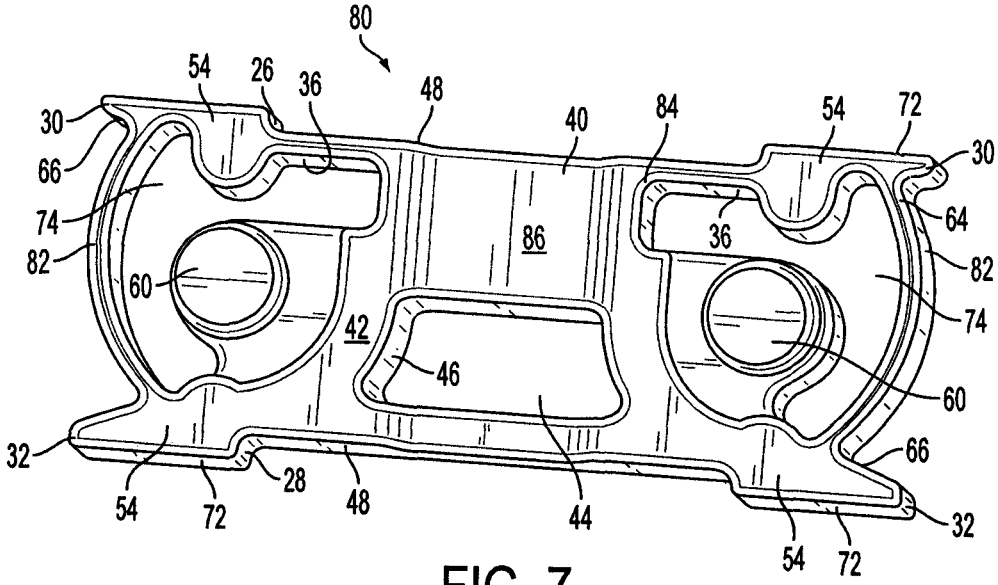
FIG. 7 is a top perspective view of an alternate embodiment of the blade guide of FIG. 1.
Figure 8:
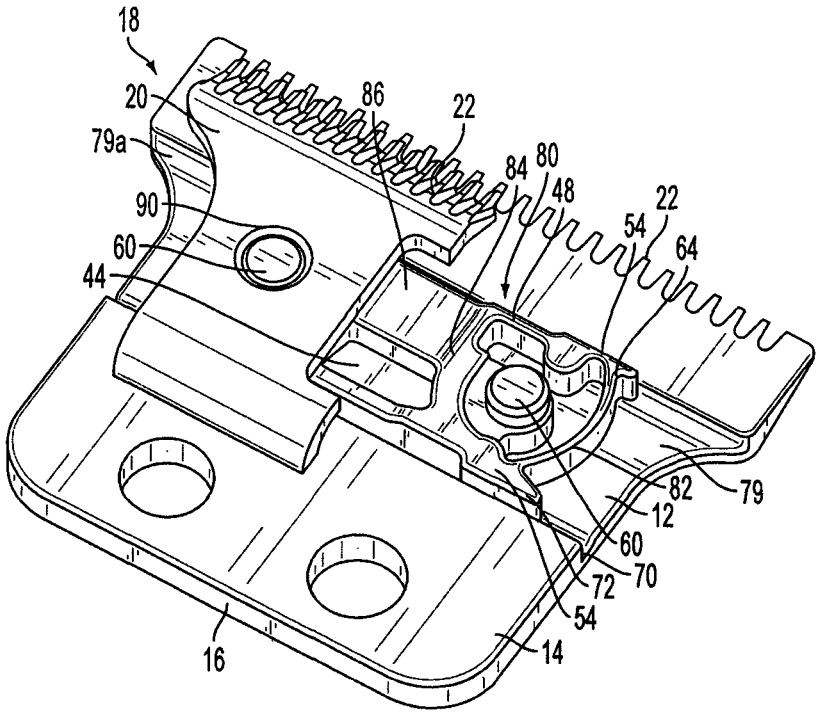
FIG. 8 is a fragmentary top perspective view of a clipper bladeset provided with the blade guide of FIG. 7.
Figure 9:
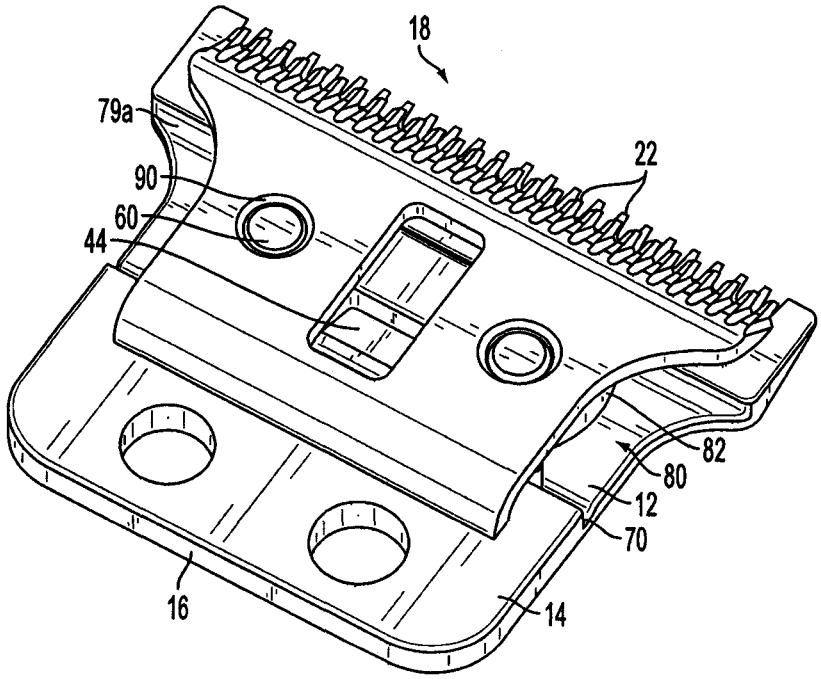
FIG. 9 is a top perspective view of the clipper bladeset of FIG. 8.

Referring now to FIGS. 7, 8 and 9, an alternate embodiment of the present guide is generally designated 80. Components shared with the guide 10 are designated with identical reference numbers, and properties shared by both guides are described in relation to the guide 10.

A major difference between the guides 80 and 10 is that in the guide 80, arched load beams 82 are concave relative to a body 84, and are complementarily concave, in that both are convex in opposite directions, curving away from each other and from a main portion 86. Despite this reversal of orientation, the arched load beams 82 function similarly to the beams 62, including their being placed in compression upon insertion of the guide 80 in the track 12. Also, in the guide 80, the body 84 is more stepped than "V"-shaped. The mounting points or bosses 60 are separated farther apart from each other compared to the mounting points 56. However, it is contemplated that the length of the guide 10 may vary to suit the situation. By being solid bosses 60, which engage openings 90 in the moving blade 20, the guide 80 does not permit adjustment of the moving blade as does the guide 10.

The configuration of the present guide 10, combined with the inherent properties of the preferred polyacetal material, combine to provide the guide with the advantage of being automatically adjustable to common manufacturing tolerance variations in the size of the stationary blade track 12. It has been found that the present guide 10 resists torsional misalignment of the moving blade 20 attached to the body as the body reciprocates relative to the stationary blade 16. Thus, a precise fit of the guide 10 in the track 12 is achieved.

Test data has shown that the size of the guide 10 is maintained at approximately 0.001 inches of interference for the life of the guide. Over time, as the blade guide 10 contact pad exterior surfaces 72 wear, material creep occurs and compensates such wear by expansion, and the guide maintains its tight fit in the track 12. Also, using the arched load beams 62, 82 accommodates variations in manufacturing tolerances better than conventional guides.

While a particular embodiment of the arched hair clipper blade guide has been described herein, it will be appreciated by those skilled in the art that changes and modifications may be made thereto without departing from the invention in its broader aspects and as set forth in the following claims.

The invention claimed is:

1. A blade guide for a hair clipper bladeset having stationary and moving blades, said guide comprising:

a blade guide body having a first edge and a second edge being generally parallel to and spaced from said first edge, each of said edges having a pair of opposed free ends, said body defining a longitudinal axis extending parallel to, and between said first and second edges; and at least one arched load beam connecting a corresponding opposed pair of said free ends of said first and second edges, said beam being arched in a plane defined by said guide body, defining a space between said beam and said body along said longitudinal axis and being configured for exerting a laterally directed, torsion-resisting biasing force between said edges, said force exerted by said beams being directed in said plane and against opposing inside surfaces of said free ends;

wherein said guide is a separate, detachable component from both the moving blade and the stationary blade and is configured for slidable engagement relative to the stationary blade in a recessed track of the stationary blade.

2. The blade guide of claim 1 wherein each said edge is provided with a pair of contact pads for slidably engaging the track, and said at least one arched load beam is connected to each of said pads and is configured with sufficient resilience so that once said guide is placed in the track, said beam is forced into compression, such that said contact pads are biased against edges of the track.

3. The blade guide of claim 1 wherein each said arched load beam is one of convex and concave relative to said body.

4. The blade guide of claim 3 wherein said at least one arched load beam includes two arched load beams having complementary directions of curvature.

5. The blade guide of claim 1 wherein contact pads on each of said first and second edges are connected to each other by a recessed arm.

6. The blade guide of claim 1 wherein said body is provided with at least one moving blade mounting point.

7. The blade guide of claim 6 wherein each said at least one mounting point includes a raised boss.

8. The blade guide of claim 7 wherein said at least one boss is one of bored and solid.

9. The blade guide of claim 1 wherein said body defines an angled truss between opposing inner surfaces of said first and second edges.

10. The blade guide of claim 9 wherein said truss is one of generally "V"-shaped and stepped.

11. The blade guide of claim 10 wherein said truss defines a cam clearance recess between inner surfaces of legs of said truss.

12. The blade guide of claim 11 wherein said body includes a solid support portion opposite said cam clearance recess, said solid support portion adjoining a recessed arm in said first edge.

13. The blade guide of claim 1 further including a generally planar lower surface.

14. The blade guide of claim 1 wherein each said free end has a contact pad for slidably engaging the track, each said first and second edge has a pair of opposed ends, and each said load beam engages said contact pads on inner surfaces at locations spaced inwardly from said corresponding ends of said first and second edges.

15. A blade guide for a hair clipper bladeset having stationary and moving blades, the stationary blade having a recessed track with spaced vertical edges, said guide comprising:

a blade guide body having a first edge and a second edge being generally parallel to and spaced from said first edge, each of said edges provided with at least one contact pad for following a corresponding edge of the track, said body defining a longitudinal axis extending parallel to, and between said first and second edges; and at least one arched load beam spaced from said blade guide body along said longitudinal axis of said body, and connecting opposing contact pads of said first and second edges to resiliently bias said pads away from each other to resist torsional misalignment of a moving blade attached to said body as said body reciprocates in the recessed track relative to the stationary blade;

wherein said guide is a detachable, separate component from both said moving blade and said stationary blade, is free of teeth and is configured for slidable engagement in the track of the stationary blade.

16. The blade guide of claim 15 wherein each said arched load beam is one of convex and concave relative to said body.

17. The blade guide of claim 16 wherein said at least one arched load beam includes two arched load beams having complementary directions of curvature.

18. A hair clipper bladeset, comprising:

a stationary blade having a toothed edge and an upper surface defining a recessed transverse track having opposed edges;

a moving blade with a toothed edge and an underside defining a guide recess;

a blade guide provided with a blade guide body having a first edge and a second edge being generally parallel to and spaced from said first edge, said body defining a longitudinal axis extending parallel to, and between said first and second edges, each said blade guide edge having a pair of opposed free ends, each of said blade guide edges configured for slidably engaging said opposed edges of said recessed track in said stationary blade; and at least one arched load beam spaced from said blade guide body along said longitudinal axis of said body, connecting opposed inside surfaces of a corresponding opposed pair of said free ends of said first and second blade guide edges and being constructed and arranged for exerting a compression-resisting biasing force between said blade guide edges such that said edges are biased against corresponding edges of said transverse track once said blade guide is slidably engaged in said track for maintaining proper alignment of said moving blade relative to said stationary blade during operational reciprocation of said moving blade relative to said stationary blade.

* * * * *